US008684197B2

(12) United States Patent
Pech et al.

(10) Patent No.: US 8,684,197 B2
(45) Date of Patent: Apr. 1, 2014

(54) CRANE WITH BOOM RAISING ASSIST STRUCTURE

(75) Inventors: David J. Pech, Manitowoc, WI (US); Joseph R. Rucinski, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 789 days.

(21) Appl. No.: 12/764,734

(22) Filed: Apr. 21, 2010

(65) Prior Publication Data

US 2010/0276385 A1 Nov. 4, 2010

Related U.S. Application Data

(60) Provisional application No. 61/174,778, filed on May 1, 2009.

(51) Int. Cl.
*B66C 23/82* (2006.01)

(52) U.S. Cl.
USPC ..... 212/260; 212/300; 212/261

(58) Field of Classification Search
USPC ..... 212/301, 302, 306, 260, 261
See application file for complete search history.

(56) References Cited

U.S. PATENT DOCUMENTS

| | | | | | |
|---|---|---|---|---|---|
| 2,371,261 | A | * | 3/1945 | Peterson | 212/301 |
| 2,741,373 | A | * | 4/1956 | Edgar | 212/302 |
| 2,813,636 | A | * | 11/1957 | Preston | 212/298 |
| 3,123,222 | A | * | 3/1964 | Livingston | 212/261 |
| 3,275,296 | A | * | 9/1966 | Meyer | 254/8 R |
| 3,426,917 | A | * | 2/1969 | Siegel | 212/264 |
| 3,534,867 | A | * | 10/1970 | Ghysels et al. | 212/264 |
| 3,794,184 | A | * | 2/1974 | Higgins | 212/295 |
| 3,836,010 | A | * | 9/1974 | Lampson | 212/195 |
| 3,912,088 | A | * | 10/1975 | Bronfman | 212/274 |
| 3,945,333 | A | * | 3/1976 | Fritsch et al. | 212/177 |

(Continued)

FOREIGN PATENT DOCUMENTS

| | | |
|---|---|---|
| DE | 28 24 944 | 12/1979 |
| EP | 0 082 377 | 6/1983 |
| JP | 50 062876 | 6/1975 |
| JP | 54 124467 | 9/1979 |

OTHER PUBLICATIONS

Liebherr "LR1750—Supplement to technical data sheet," (pp. 1-9) (dated prior to May 1, 2009).

(Continued)

*Primary Examiner* — Emmanuel M Marcelo
*Assistant Examiner* — Michael Gallion
(74) *Attorney, Agent, or Firm* — Steven P. Shurtz; Brinks Gilson & Lione

(57) ABSTRACT

A lift crane includes a carbody; ground engaging members elevating the carbody off the ground; a rotating bed rotatably connected to the carbody; a boom pivotally mounted at a first end to the rotating bed with a load hoist line extending adjacent a second end of the boom; a boom hoist mechanism that can be used to change the angle of the boom relative to the rotating bed during crane operation; and a boom raising assist structure connected to the boom. The boom raising assist structure preferably includes at least one ground engaging member in contact with the ground; and a boom elevating member extending between the assist structure ground engaging member and the boom. The boom elevating member supports at least a part of the weight of the boom.

25 Claims, 5 Drawing Sheets

(56) References Cited

U.S. PATENT DOCUMENTS

| | | | | | |
|---|---|---|---|---|---|
| 4,050,586 | A | * | 9/1977 | Morrow et al. | 212/298 |
| 4,169,535 | A | * | 10/1979 | Bryan, Jr. | 212/293 |
| 4,226,331 | A | * | 10/1980 | Dumond | 212/258 |
| 4,352,434 | A | * | 10/1982 | Poock | 212/298 |
| 4,444,416 | A | * | 4/1984 | Soderstrom | 280/763.1 |
| 4,518,090 | A | * | 5/1985 | Thomasson | 212/261 |
| 4,557,390 | A | * | 12/1985 | Mick | 212/197 |
| 4,730,742 | A | * | 3/1988 | Feterl | 212/299 |
| 4,962,827 | A | * | 10/1990 | Garnett | 182/2.11 |
| 5,014,863 | A | * | 5/1991 | Vlaanderen | 212/299 |
| 5,211,526 | A | * | 5/1993 | Robinette | 414/550 |
| 5,240,129 | A | * | 8/1993 | Schrick et al. | 212/175 |
| 5,281,078 | A | * | 1/1994 | Mills, Jr. | 414/680 |
| 5,387,071 | A | * | 2/1995 | Pinkston | 414/563 |
| 5,480,041 | A | * | 1/1996 | Turner | 212/273 |
| 5,584,645 | A | * | 12/1996 | Kaspar | 414/728 |
| 6,039,194 | A | * | 3/2000 | Beeche et al. | 212/301 |
| 6,131,750 | A | * | 10/2000 | Harrington | 212/177 |
| 6,155,776 | A | * | 12/2000 | Moyna | 414/813 |
| 6,478,528 | B1 | * | 11/2002 | Asbury | 414/550 |
| 7,172,082 | B2 | * | 2/2007 | Irsch et al. | 212/231 |
| 7,213,716 | B2 | * | 5/2007 | Willim et al. | 212/298 |
| 7,331,748 | B2 | * | 2/2008 | Knepp et al. | 414/686 |
| 7,762,412 | B2 | * | 7/2010 | Porubcansky | 212/299 |
| 2001/0045405 | A1 | * | 11/2001 | Higgins | 212/231 |
| 2004/0217079 | A1 | * | 11/2004 | Higgins | 212/298 |
| 2008/0264887 | A1 | * | 10/2008 | Porubcansky | 212/198 |
| 2009/0277857 | A1 | * | 11/2009 | Rice | 212/302 |
| 2010/0072156 | A1 | * | 3/2010 | Mentink et al. | 212/196 |

OTHER PUBLICATIONS

Liebherr "LR1600/2—Technical Data," (pp. 1-6 ) (dated prior to May 1, 2009).

* cited by examiner

CRANE WITH BOOM RAISING ASSIST STRUCTURE

REFERENCE TO EARLIER FILED APPLICATION

The present application claims the benefit of the filing date under 35 U.S.C. §119(e) of Provisional U.S. Patent Application Ser. No. 61/174,778, filed May 1, 2009; which is hereby incorporated by reference in its entirety.

BACKGROUND

The present invention relates to lift cranes with a pivotal boom having a load hoist line extending from the boom, and particularly to a lift crane with an assist structure for helping to raise the boom during a set-up operation.

Lift cranes typically include a carbody; ground engaging members elevating the carbody off the ground; a rotating bed rotatably connected to the carbody such that the rotating bed can swing with respect to the ground engaging members; and a boom pivotally mounted on the rotating bed, with a load hoist line extending therefrom. Lift cranes with a pivotal boom also include a boom hoist mechanism that can be used to change the angle of the boom relative to the rotating bed during crane operation. For mobile lift cranes, there are different types of moveable ground engaging members, most notably tires for truck mounted cranes, and crawlers. Typically lift cranes include a counterweight to help balance the crane when the crane raises the boom or lifts a load. Also, lift cranes are typically built with booms made of multiple boom sections, some of different lengths, to construct booms of different lengths. In this way a crane can be assembled with a different length boom based on the lift to be performed, with longer booms being used when the lift to be performed involves a greater height or longer reach.

Lift cranes are typically designed based on the largest load that they can lift, and also have to be designed taking into account the moment created by the load and the boom when the crane lifts the load at various boom angles and lengths of boom. Typically a crane manufacturer will provide load charts for each crane it sells, showing the maximum loads that can be lifted at different boom angles for each boom length. These load charts take into account the structural capability and stability of the crane design. Structural capability relates to the fact that the crane components can withstand the loads on the individual parts that are generated as a lift is performed. For example, a slewing ring has to be built out of pieces with enough strength so that when a crane lifts a load, the forces on each component of the slewing ring, such as the rollers, can be withstood. Likewise, the boom has to be built so that it does not buckle when all of the compressive forces act on the individual members of the boom. For many components the structural capability is concerned with both direct forces and moment forces, and has to take into account the fact that the crane can swing or travel with a load on the hook. Stability, on the other hand, is mostly concerned with the crane as a whole being able to stay upright during crane lifting operations. If too large of a load is lifted at a low boom angle, the moment created by the load and the outstretched boom measured from the front fulcrum (typically the furthest point where the crane's crawlers engage the ground) might cause the crane to tip over. Adding counterweight increases the stability of the crane, but then also requires the structural capacity of the crane to be increased.

In addition to the maximum load that can be lifted, a lift crane has a limit to the weight and length of the boom that can be raised off the ground by the crane during crane set-up. Booms that can withstand greater compression, and thus increase the maximum lift capacity of the crane, usually require greater cross sections and thicker members. These features, however, increase the weight per unit length of the boom. When a crane is trying to lift the boom off the ground during a set-up operation, the boom is at a horizontal boom angle, and the moment created by just the weight of the boom and items fixed on the boom top are tremendous.

Most crane designs are balanced such that both the structural capability and the cranes stability limit the maximum length of boom that can be raised from the ground. In practice, it is common to have slightly more structural capability than stability, i.e., stability generally governs the maximum boom length and weight that can be raised.

Crane users would like to be able to raise longer booms to achieve greater reach, or booms with more weight to achieve greater capacity. In some cases users want both more length and capacity. In times past it was possible to use a longer/heavier boom than the crane could lift by itself by having an assist crane on site to assist with boom raising and lowering when the crane is assembled and disassembled. However, if the boom needs to be lowered in an emergency, and the assist crane is not available, there is no easy way to lower the boom to the ground without causing the crane to tip.

Crane manufactures have responded by providing features on their cranes that allow the crane to raise a longer boom than might be otherwise possible. For example the Liebherr LR1600/2 model crane is equipped with an added pair of raising supports to one side of the carbody. These increase the fulcrum and thus provide greater boom raising stability. However, because the raising supports are on the carbody, the entire crane's structural system (all structural components) must be increased to allow a longer/heavier boom to be raised.

Thus there is a need for a way to supplement the stability of a crane in such a way that the crane can raise a longer and/or heavier boom during the crane set-up operation without the need to increase the structural capacity of the crane, and which does not require that an assist crane be readily available.

BRIEF SUMMARY

A lift crane boom raising assist structure has been invented that works in conjunction with the crane's normal boom hoist system to provide additional boom raising capability. The assist force is applied at the boom. The loadings in the crane's structural components are not significantly impacted.

In a first aspect, the invention is a lift crane comprising a carbody; ground engaging members elevating the carbody off the ground; a rotating bed rotatably connected to the carbody; a boom pivotally mounted at a first end to the rotating bed with a load hoist line extending adjacent a second end of the boom, a boom hoist mechanism that can be used to change the angle of the boom relative to the rotating bed during crane operation; and a boom raising assist structure connected to the boom comprising: at least one ground engaging member in contact with the ground; and a boom elevating member extending between the assist structure ground engaging member and the boom, the boom elevating member supporting at least a part of the weight of the boom.

In a second aspect, the invention is a mobile lift crane comprising a carbody; moveable ground engaging members elevating the carbody off the ground; a rotating bed rotatably connected to the carbody; a boom pivotally mounted at a first end to the rotating bed with a load hoist line extending adjacent a second end of the boom; a boom hoist drum connected to the rotating bed and boom hoist rigging connected between the boom hoist drum and the second end of the boom, the boom hoist drum and rigging being useable to change the angle of the boom relative to the rotating bed; and a boom raising assist structure connected to the boom comprising two hydraulic cylinders each having a jack pad on a lower end thereof.

In a third aspect, the invention is a method of setting up a lift crane wherein the lift crane comprises, during operation, a carbody; ground engaging members elevating the carbody off the ground; a rotating bed rotatably connected to the carbody; a boom pivotally mounted at a first end to the rotating bed with a load hoist line extending adjacent a second end of the boom; a boom hoist mechanism that can be used to change the angle of the boom relative to the rotating bed during crane operation; and a boom raising assist structure; the method comprising: a) attaching the first end of the boom to the rotating bed and constructing the boom, with the boom extending out from the rotating bed parallel to the ground and being supported by the ground in a first position, and the weight and length of the boom being sufficient to generate a moment that would tip the crane if the crane boom hoist mechanism were to attempt to lift the boom off the ground without using the boom raising assist structure; b) positioning the boom raising assist structure between the ground and the boom, with the boom raising assist structure connected to the boom; c) using the boom raising assist structure and the boom hoist mechanism together to pivot the boom about its connection to the rotating bed, and raising the boom from the first position to a second position defining a first boom angle, the first boom angle being at least as large as the boom angle needed so that the moment generated by the boom will no longer tip the crane even if the boom raising assist structure were no longer in contact with the ground; and d) using the boom hoist mechanism to raise the boom to a second angle steeper than the first angle, where the boom raising assist structure is no longer in contact with the ground.

One exemplary boom raising assist structure utilizes two telescopic (three stage) cylinders adjacent to the boom butt. Force from these cylinders works in conjunction with the crane's normal boom hoist mechanism to provide additional boom raising capability. This exemplary design provides cylinder assist force from the ground to a boom angle of 35° to 40° . At this angle, the moment from the boom has decreased and the boom hoist geometry has improved such that the crane's stability and normal boom hoist mechanism can support the boom. The boom raising assist structure is also used to provide added stability when the boom is lowered to the ground. These and other advantages of the invention, as well as the invention itself, will be more easily understood in view of the attached drawings.

DETAILED DESCRIPTION OF THE DRAWINGS AND THE PRESENTLY PREFERRED EMBODIMENTS

Figure 1:
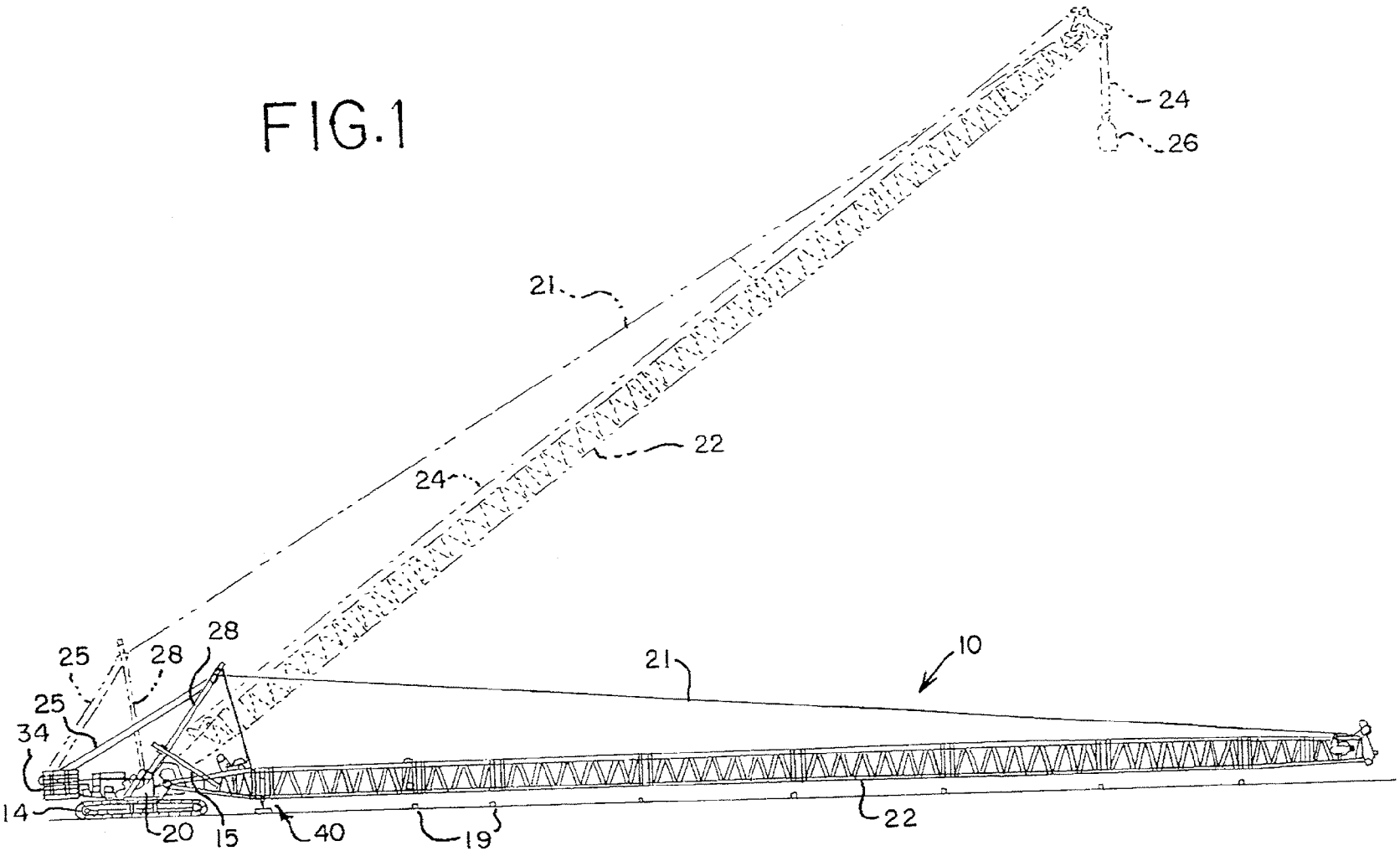
FIG. 1 is a side elevational view of a mobile lift crane using the present invention, shown in a set-up position in solid lines and an operational position in dashed lines.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The following terms used in the specification and claims have a meaning defined as follows.

The term "center of gravity of the boom" refers to the point about which the boom could be balanced. In calculating the center of gravity, all of the components attached to the boom structure that have to be lifted when the boom is initially raised, such as any sheaves mounted in the boom top for the load hoist line, must be taken into account.

Since booms may have various cross section shapes, but are designed with a centerline about which compressive loads are preferably distributed, the term "boom angle," means the angle of the centerline of the boom compared to horizontal.

The term "horizontal boom angle" refers to the boom being at a position where the boom is at or very close to a right angle with the direction of gravity. Likewise, the term "parallel to the ground" has the same meaning. Both of these terms have a meaning that takes into account small variations that occur in normal crane set-up and usage, but which a person of ordinary skill in the art would still think of as being horizontal. For example, when a boom is originally assembled on the ground before being lifted into an operational position, it is considered to be at a horizontal boom angle even if the ground is not exactly level or if parts of the boom are on blocks. The boom can be slightly above or slightly below an exact horizontal position depending on the blocking used, and still be considered to be at a horizontal boom angle and parallel to the ground.

The term "extendable cylinder" refers to a cylinder that has at least one stage of extension. Thus a simple hydraulic cylinder with a rod that extends out of a cylinder is considered to be an extendable cylinder for the present application. In addition to hydraulic cylinders, air powered cylinders also fit in the category of extendable cylinders. Multistage telescopic cylinders also come within the meaning of the term "extendable cylinder".

As noted above, stability is mostly concerned with the crane as a whole being able to stay upright during crane lifting operations. Front tipping stability for lift cranes that have an upper works that rotates about a lower works may be expressed as a ratio of a) the distance between the center of gravity of the entire crane and the axis of rotation to b) the distance between the front fulcrum (typically the furthest point where the crane's crawlers engage the ground) and the axis of rotation. Thus if the distance between the center of gravity of the entire crane and the axis of rotation were 4.5 meters, and the distance between the front tipping fulcrum from the axis of rotation were 5 meters, the stability would be 0.9. The lower the value of this ratio, the more stable the crane is. Of course the center of gravity of the crane is a function of the relative magnitudes and relative positions of the centers of gravity of the different crane components. Thus, the length and weight of the boom and the boom angle can greatly influence the location of the center of gravity of the entire crane, and thus its stability. Raising the boom will increase the stability of a crane because the center of gravity of the boom is brought closer to the axis of rotation, and thus the center of gravity of the entire crane is brought closer to the axis of rotation. The stability number is thus lower, as the numerator of the ratio decreases, signifying that the crane is more stable.

When determining the center of gravity of the entire crane, it is often useful to determine contributions to that center of gravity by considering the weight of each individual crane component and the distance that the center of gravity of that component is from a point of reference, and then use a summation of the moments generated about that reference point by each crane component. The individual values in the summation are determined by multiplying the weight of the component by the distance between the center of gravity of that component and the reference point. For front tipping stability calculations, it is common to use the front tipping fulcrum as the reference point when making the summation to determine the center of gravity of the entire crane.

When considering the moment generated by the boom, it is common to separate the total boom weight, located at the center of gravity of the entire boom, into two separate weights, one at the boom butt called the "boom butt weight", and one at the boom top called the "boom top weight". The total weight of the boom will be equal to the boom top weight plus the boom butt weight. Those weights are determined by calculating what force would be generated if the boom were simply supported at each end, with the assumptions that the load hoist line reaches to but is not reeved through the boom top, and that the boom straps are connected. Thus, if one scale were placed under the boom butt at the point the boom connects to the rotating bed (the boom hinge point) and another scale were placed under the boom top at the point the boom top sheaves are connected, the weight on the two scales combined would of course be the weight of the boom, and the individual scale weights would be the boom butt weight and the boom top weight, respectively.

One way to look at the stability of a crane during boom raising from the ground or lowering to the ground is to consider the "boom reserve." The boom reserve is the amount of additional weight that could be added at the top of the boom to bring the stability to a value of 1.0. For example, if a boom in a specified crane configuration was able to be hoisted up from a horizontal position by the boom hoisting mechanism in the crane without the crane tipping, and if adding 3,000 pounds of weight to the boom top would make it so that the center of gravity of the entire crane was moved out to a point directly above the front tipping fulcrum (meaning that if the boom were attempted to be raised, the rear of the crane would come off the ground just as readily as the boom would be lifted off the ground), then the crane and boom in the specified configuration would have 3,000 pounds of boom reserve. The higher the boom reserve, the greater the safety factor, assuring that during raising the boom from ground level and lowering the boom to ground level the crane will not tip.

While the invention will have applicability to many types of cranes, it will be described in connection with mobile lift crane 10, shown in an operational configuration in FIG. 1. The mobile lift crane 10 includes lower works, also referred to as a carbody, and moveable ground engaging members in the form of crawlers 14. There are of course two crawlers 14, though only one of the crawlers can be seen in the side views of crane 10. In the crane 10, the ground engaging members could be two sets of crawlers, a front and a rear crawler on each side. Of course additional crawlers than those shown can be used, as well as other types of ground engaging members, such as tires.

The rotating bed 20 is mounted to the carbody with a slewing ring, such that the rotating bed can swing about an axis with respect to the ground engaging members 14. The rotating bed supports a boom 22 pivotally mounted on a front portion of the rotating bed and a boom hoist mechanism that can be used to change the angle of the boom relative to the rotating bed during crane operation. In the crane 10, the boom hoist mechanism comprises a boom hoist drum 50 connected to the rotating bed and boom hoist rigging (described in more detail below) connected between the boom hoist drum and the second end of the boom. The boom hoist mechanism also includes a live mast 28 mounted at its first end on the rotating bed, with an upper sheave set 38 connected to the mast adjacent the second end of the mast, and a lower sheave set 37 mounted on the rear of the rotating bed. The crane 10 also includes a counterweight unit 34. The counterweight may be in the form of multiple stacks of individual counterweight members on a support member.

During normal crane operation, a load hoist line 24 is reeved over at least one pulley on the boom 22 and will support a hook block 26. More typically, the boom top and hook block with each include multiple sheaves through which the load hoist line is reeved, providing a block and tackle effect. At the other end, the load hoist line is wound on a load hoist drum 70 connected to the rotating bed. The boom hoist drum may be connected to the rotating bed by being located on another member that in turn is connected to the rotating bed. The rotating bed 20 includes other elements commonly found on a mobile lift crane, such as an operator's cab and the boom hoist drum 50 for the boom hoist rigging. A second hoist drum 80 for a whip line may be mounted on the boom butt.

Boom hoist rigging between the rotating bed 20, top of mast 28 and boom 22 is used to control the boom angle and transfer load so that the counterweight can be used to balance a load lifted by the crane. The boom hoist rigging includes a boom hoist line in the form of wire rope 25 wound on boom hoist drum 50, and reeved through sheaves on a lower sheave set 37 and an upper sheave set 38. The boom hoist drum 50 is mounted in a frame connected to the rotating bed. The rigging also includes fixed length straps 21 connected between the boom top and the shaft at the top of the mast 28 on which the pulleys of the upper sheave set 38 are mounted. This arrangement allows rotation of the boom hoist drum 50 to change the amount of boom hoist line 25 between the lower sheave set 37 and the upper sheave set 38, thereby changing the angle between the rotating bed 20 and the mast 28, which in turn changes the angle between the boom 22 and the rotating bed 20.

A boom stop 15 is connected to the boom and travels with the boom. However, at steep boom angles the boom stop 15 contacts the rotating bed and stops the boom from tipping over backward. If the boom 22 were to recoil backward beyond its maximum designed nearly-vertical position, compressive loads would be transmitted through the boom stop 15 to the rotating bed.

As discussed above, the boom 22 is constructed by connecting multiple boom sections together. The boom section pivotally connected to the rotating bed constitutes a boom butt 27. As noted above, the boom is supported during crane operation by a pair of boom straps 21 each made from sections.

The crane 10 differs from a conventional crane in several respects. First, the weight and length of the boom generate a moment that would tip the crane 10 if the crane boom hoist mechanism were to attempt to lift the boom off the ground by itself while the boom was extending out from the rotating bed parallel to the ground. Second, the crane 10 includes a boom raising assist structure 40 interposed between the boom and the ground at low boom angles. The boom raising assist structure 40 is used to help raise the boom to an angle at which the moment generated by the boom will no longer tip the crane even if the boom raising assist structure is no longer in contact with the ground.

The boom raising assist structure 40 is connected to the boom 22, preferably between the first end of the boom, which is pivotally connected to the rotating bed 20, and the center of gravity of the boom. Preferably the boom raising assist structure is relatively close to the rotating bed connection, so that the distance that the structure has to rise is small compared to the increase in boom angle generated by that rise, but far enough away from the rotating bed connection so as to minimize the force required. The boom raising assist structure must be located forward of the machine tipping fulcrum. The connection location is dependent on two things: the stroke (travel distance) of the cylinder and the force of the cylinder. While one would like to keep the stroke within a reasonable range, one would also like to minimize the force, both because of design aspects of the cylinder itself, and because the boom must carry the load that the cylinder applies to it. To minimize the force one would like to move further away from the boom hinge, but this increases the stroke required. To minimize the stroke one would like to stay as close to the fulcrum as possible, but this increases the total force of the cylinder. So, there is a balance between the two that will vary for each system the boom raising assist structure is used on. In addition, because the boom is typically constructed from boom sections, if the boom raising assist structure is provided as a separate unit that fits between already designed boom sections, the location of the boom raising assist structure will have to be at one of the junctures between boom sections. In that regard, it may preferably be connected where the boom butt 27 or first short boom segment connects to the remaining boom sections. Of course the boom raising assist structure could be designed to connect to an existing boom segment, providing more flexibility in its location.

The boom raising assist structure 40 includes at least one ground engaging member in contact with the ground; and a boom elevating member extending between the assist structure ground engaging member and the boom, the boom elevating member supporting at least a part of the weight of the boom when it is in use. The boom elevating member is positionable so that it can help support the boom when the boom is at a horizontal position relative to the ground and can continue to help support the boom when the boom is raised to an angle at which the crane has a stability of not greater than 1.0. This point may be reached at a low boom angle, such as 5° , when the boom is only slightly longer or heavier than is normally used on the crane. Preferably the elevating member can support the boom until it has been raised to a position where the cane has a boom reserve of at least 1% of the boom top weight, and more preferably to a position where the crane has a boom reserve of between about 2% and about 5% of the boom top weight. Typically this will be at an angle of between 20° to 45° , and more preferably at an angle of between about 35° and about 45° , relative to the ground. Further, the boom elevating member is connected to the boom with a pivotal connection allowing the boom elevating member to pivot about the boom connection as the boom is raised.

Figure 7:
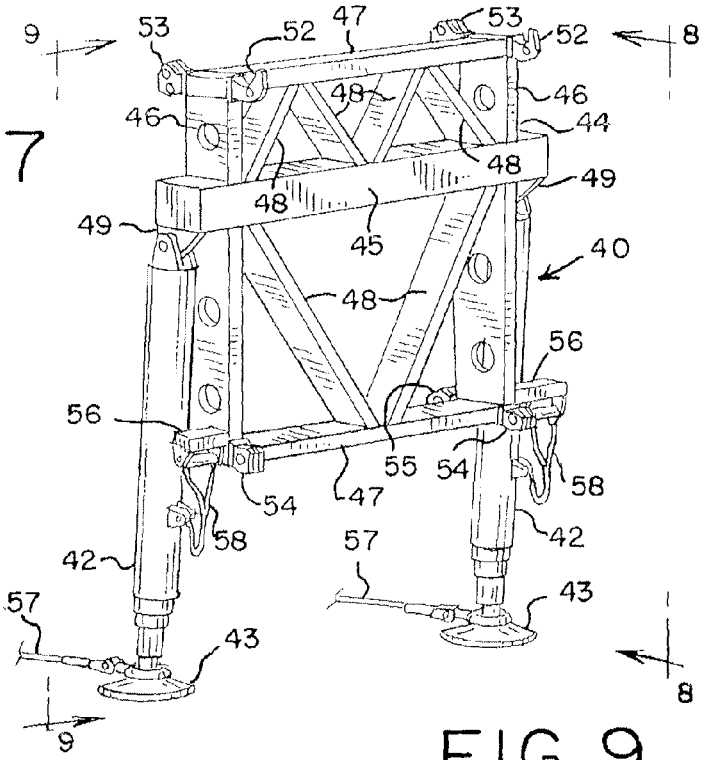
FIG. 7 is a perspective view of the boom raising assist structure used in the crane of FIG. 1.
Figure 8:
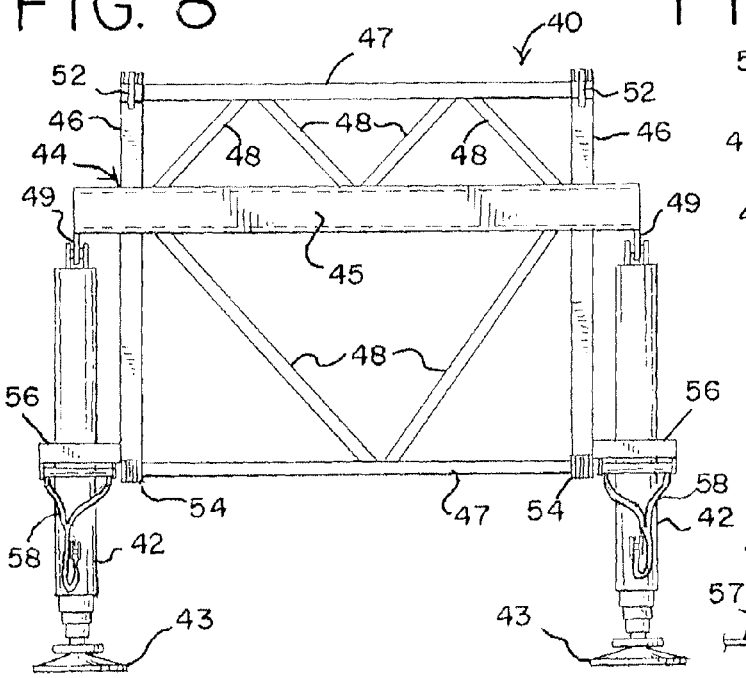
FIG. 8 is a front elevational view of the boom raising assist structure taken along line 8-8 of FIG. 7.
Figure 9:
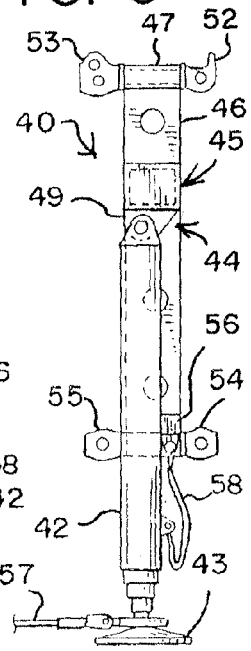
FIG. 9 is a side elevational view of the boom raising assist structure taken along line 9-9 of FIG. 7.

As best seen in FIGS. 7-9, the boom elevating member is preferably made from at least one, and more preferably two single or multi-stage extendable cylinders 42. The cylinders 42 are pivotally connected to a frame 44 that is interconnected with the boom sections. The extendable cylinders 42 are preferably telescoping cylinders and are preferably multi-stage hydraulic cylinders. In the preferred embodiment shown, each cylinder 42 has three stages. Using at least three stage cylinders allows the cylinders to be kept short in a retracted position so that they can be interposed between the boom and the ground when the boom is at a horizontal position relative to the ground, but be extended to a great enough height so that the boom is raised to a point that the moment of the boom will not tip the crane. The two multistage hydraulic cylinders each have a jack pad 43 on a lower end as the assist structure ground engaging member.

The frame 44 includes a main cross member 45, two side members 46 top and bottom members 47, and bracing 48. The cylinders 42 are secured to the frame 44 by attaching with a pinned connection at the bottom of plates 49 welded to the ends of the main cross member 45. In this way the cylinders 42 and the frame 44 are secured to the boom 22 such that the cylinders 42 can pivot with respect to the boom 22 between a first position in which the cylinders 42 are generally perpendicular to the centerline of the boom and a second position where the angle between the centerline of the boom and the hydraulic cylinders will facilitate proper positioning of the jack pads 43 when the boom raising assist structure is used while the boom is being lowered to the ground. The second position is chosen such that, when the boom is being lowered to the ground and reaches an angle at which the boom raising assist structure is activated to provide stability, the cylinders will be angled to direct the jack pads towards points on the ground a distance in front of the crane substantially equal to the distance that the hydraulic cylinders are from the front of the crane when the boom is in a horizontal position. In this way, the cylinders will once again be near vertical when the boom is parallel with the ground, which is when the maximum force is being applied by the cylinders. In some embodiments, the second position will produce an angle between the cylinders and the centerline of the boom of less than 60° (see FIG. 6).

The frame 44 is preferably connected between sections of the boom, such as between the boom butt 27 and the first boom insert section 29. In other embodiments, the frame could also be connected to an insert above the boom butt. Attached to the top of the frame 44 are male hook-shaped boom section connectors 52 on the outward facing side of the frame, and female boom section connectors 53 on the inward facing side of frame 44. (The invention can of course be used on booms with other types of connections, such as conventional four pin connectors.) Attached to the bottom of the frame are male connectors 54 on the outward facing side, and female connectors 55 on the inward facing side. These boom section connectors are standard and connect with similar connectors on the boom butt 27 and first boom insert section 29, so that if the boom raising assist structure 40 is not needed because the crane 10 is being assembled with a short boom, the first boom insert section 29 connects directly to the boom butt 27 using the standard boom section connectors.

Figure 6:
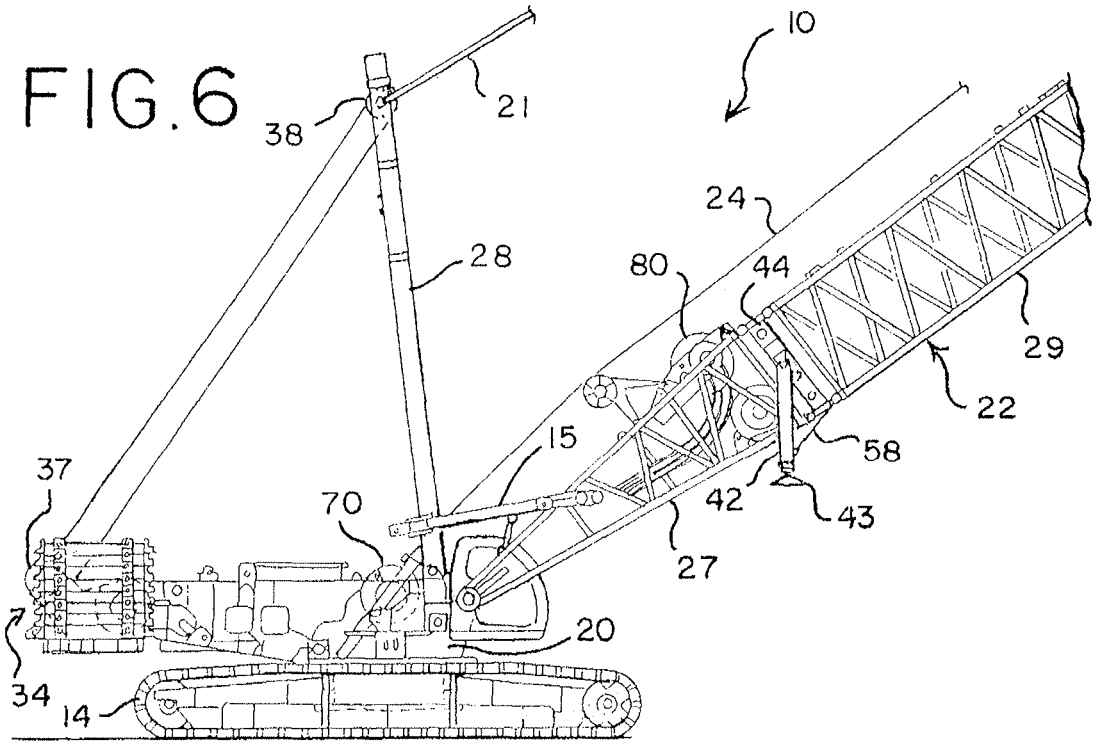
FIG. 6 is an enlarged side elevational view of the portion of the crane of FIG. 2 in an operational position.

An extension 56 extends from each of the side members 46 of the frame 44 near the position of the bottom member 47. The extensions prevent the bottom of the cylinders 42 from swinging forward. In addition, a pendant 57 may be connected between the carbody and each jack pad 43 to hold the jack pad from sliding forward when the cylinders 42 are extended. Once the boom is raised, the crane is in an operational position and the boom raising assist structure is no longer being used, a pendant 58 is used to connect between the boom and the cylinder 42 to prevent the bottom of cylinder 42 from swinging backward (FIG. 6). Pendant 58 also positions the cylinder 42 to the correct angle when the boom is being lowered so the jack pads 43 will contact the ground near the same position (relative to the front of the crane) as when the boom was raised. As best seen in FIG. 7, the pendant 58 is attached to the boom via frame 44 and extension 56.

Figure 2:
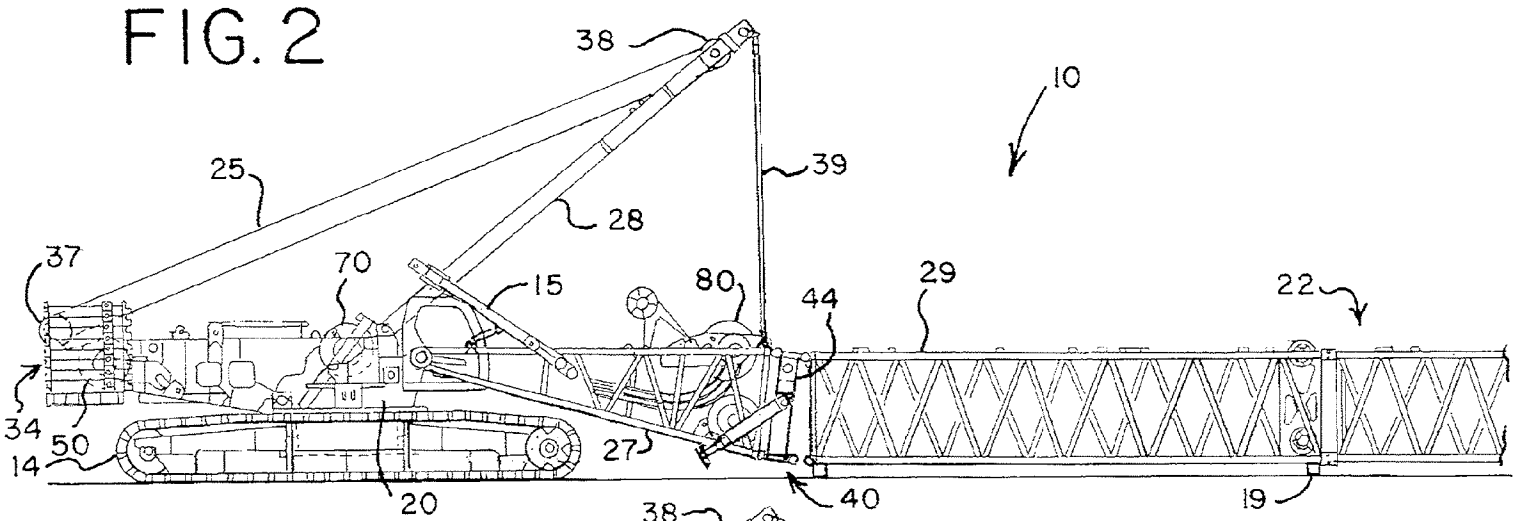
FIG. 2 is an enlarged side elevational view of a portion of the crane of FIG. 1 in an initial stage set-up position.

A method of setting up the lift crane 10 includes first attaching the first end of the boom to the rotating bed and constructing the boom, with the boom extending out from the rotating bed parallel to the ground and being supported at multiple points by the ground. As seen in FIG. 2, the boom butt 27 is first attached to the rotating bed 20. The frame 44 is attached to the boom butt 27, and the boom sections are attached to one another as they are laid out on blocks 19 on the ground. The hydraulic cylinders 42 are tied back to the boom butt to provide ground clearance. The boom butt 27 and frame 44 are only partially connected to the first boom insert section 29 when the boom is supported by the ground on blocks 19. While the connectors 53 and 55 on the rear of the frame 44 are connected to the boom butt 27, only the top boom section connectors 52 are engaged (and then only partially but rotatable engaged) with the top connectors on the first boom insert section 29, because the point of connection of the boom butt 27 to the rotating bed is not at the same elevation as the center line of the boom when the boom sections rest on the blocks 19 on the ground.

Figure 3:
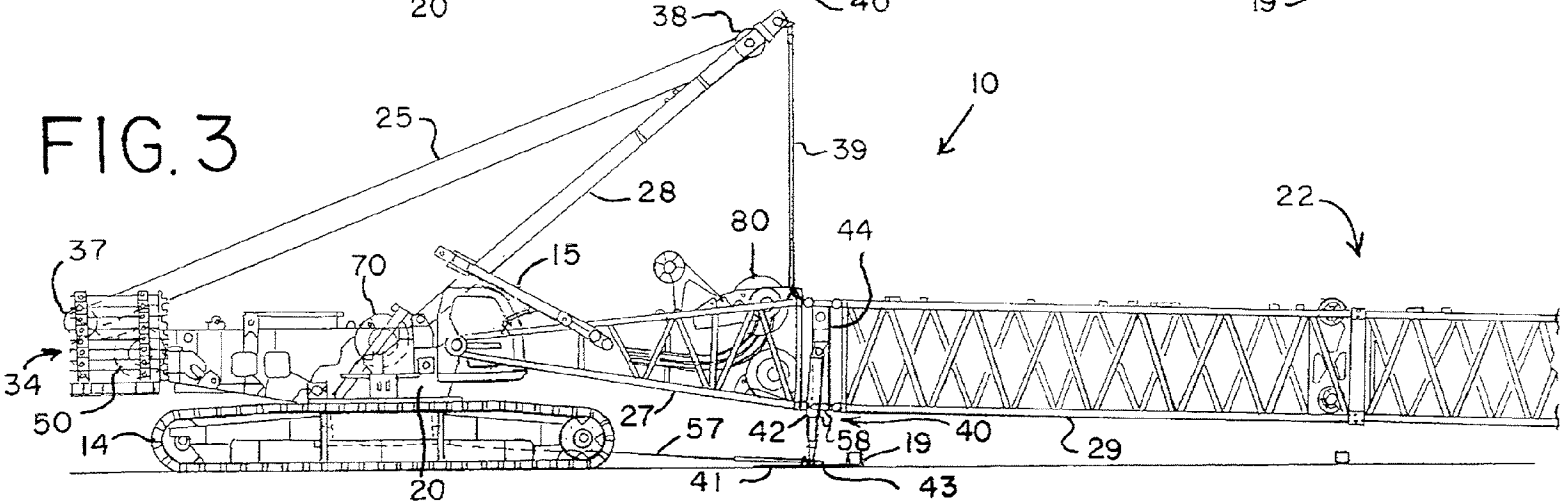
FIG. 3 is an enlarged side elevational view of the portion of the crane of FIG. 2 in a second stage set-up position.

Second, the boom raising assist structure 40 is positioned between the ground and the boom 22, with the boom raising assist structure preferably being connected to the boom between the rotating bed and the center of gravity of the boom. There may be several different intermediate steps in this operation. As seen in FIG. 3 this can be accomplished by attaching boom handling pendants 39 between the live mast 28 and the boom butt 27. The live mast is then used to lift the boom butt 27 to a point where the boom raising assist structure can be positioned between the ground and the boom, with the second end of the boom still being supported by the ground. Of course the live mast is raised by drawing in boom hoist line 25 onto drum 50, thus reducing the length of the line running between the lower sheave set 37 and the upper sheave set 38. The boom hoist structure is used to lift the boom to the point shown in FIG. 3 where the bottom boom section connection on boom insert 29 can be pinned to the bottom connectors 54 on frame 44. At this point the mast 28 is lowered so that the boom handling pendants 39 can be removed, leaving the weight of the boom distributed between the boom hinge point on the rotating bed and the top of the boom resting on the ground. The boom straps 21 are then installed between the mast 28 and the top of the boom. Thereafter the boom hoist mechanism is used in its normal manner, acting through the live mast 28 to help raise the boom from its outer end. The cylinders 42 are then swung from a storage position to the working position, and the pendants 57 are connected between the carbody of the crane and the jack pads 43. The cylinders 42 are then extended so that the jack pads reach the ground. It may be preferable to put a steel plate 41 on the ground under the jack pads 43 for pad support and sliding the pads into place.

Figure 4:
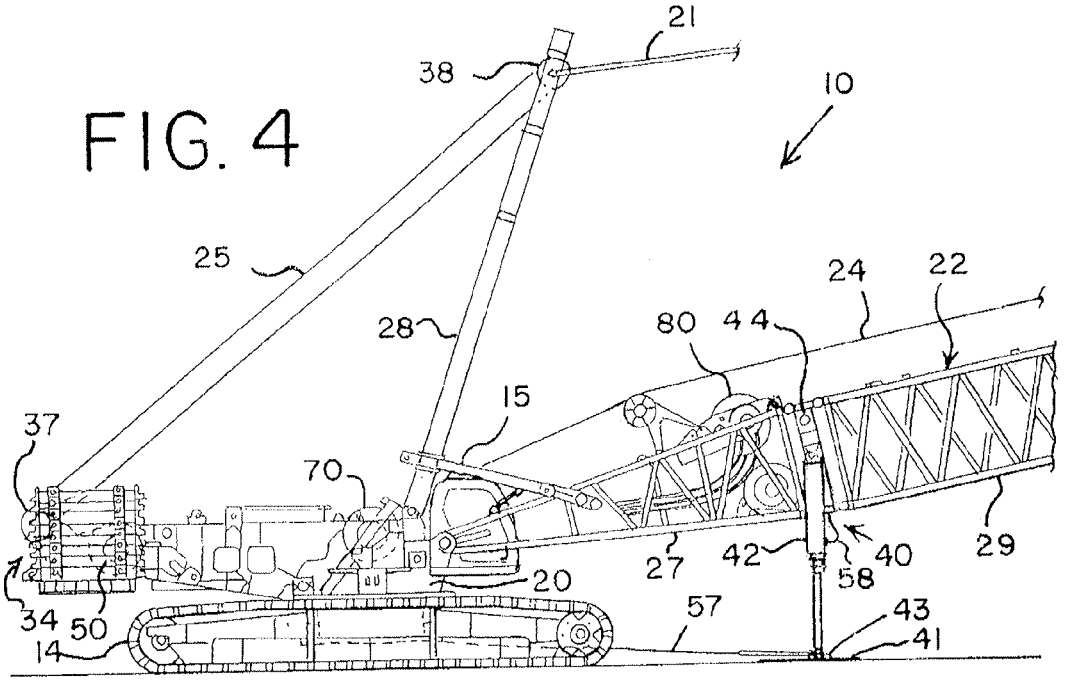
FIG. 4 is an enlarged side elevational view of the portion of the crane of FIG. 2 in a third stage set-up position.
Figure 5:
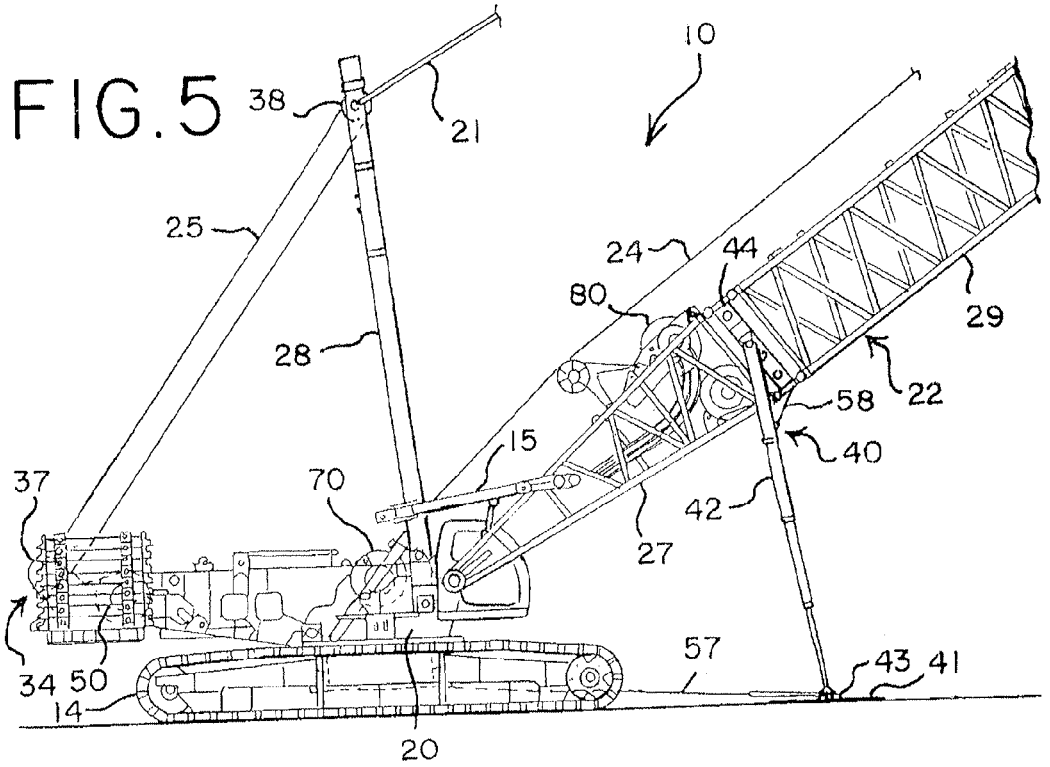
FIG. 5 is an enlarged side elevational view of the portion of the crane of FIG. 2 in a fourth stage set-up position.

Third, both the boom raising assist structure 40 and the boom hoist mechanism are used together to pivot the boom 22 about its connection to the rotating bed 20, thus raising the boom from a first position where the boom is supported by the ground to a second position (FIG. 5) where the boom is raised to a first angle compared to the surface of the ground. Where multistage telescoping cylinders are used, the boom will be raised to intermediate points such as seen in FIG. 4 as each stage of the cylinders 42 is extended. This first angle to which the boom is raised by the combined boom hoist mechanism and the boom raising assist structure is at least as large as the boom angle needed so that the moment generated by the boom will no longer tip the crane even if the boom raising assist structure were no longer in contact with the ground. In other words, an angle at which the moment of the boom is reduced so that there is a boom reserve. This will be past the exact point where the crane will not tip if the boom raising assist structure is no longer used. The first angle will typically be where there is a boom reserve of at least 1% of the boom top weight, and more preferably between about 2% and about 5% of the boom top weight. For certain models of crane, the first angle will produce at least 3,000-5,000 pounds of reserve. Depending on the crane and boom configuration, this first angle may generally be at least 5°. However, longer/heavier booms can be used on the crane if the boom raising assist structure can help raise the boom to a first angle greater than 5°. More typically the first angle will be between about 20° and 45°. Preferably the extended length of the cylinders 42 is sufficient to help raise the boom to an angle of between about 35° and about 45°. The angle to which the boom will be raised in the assisted mode is of course a function of the extended length and placement of the boom assist structure.

At some point, preferably after the pendants 39 are removed but before the second end of the boom is very high off the ground, the load hoist line 24 is drawn out from load hoist drum 70 (FIG. 4) and reeved through the sheaves at the boom top and in hook block 26. This increases the boom top weight, as the weight of the load hoist line is now carried partially by the boom top. Because of its weight, the hook block is expected to remain on the ground as the boom is initially raised.

Fourth, the boom hoist mechanism is used to raise the boom to a second angle steeper than the first angle, where the boom raising assist structure 40 is no longer in contact with the ground, as shown in FIG. 6. Preferably the boom raising assist structure remains attached to the boom when the boom is at this second, operational angle. Thereafter the crane can be used for normal lifting activities. However, the crane operator will need to avoid lowering the boom to a low boom angle (even without any load) where the moment of the boom itself would cause the crane to tip. When the boom needs to be lowered to angles below the first angle, such as when it is time to disassemble the crane, the boom will be lowered to a position where the cylinders can be extended to reach the ground. From that point down the cylinders 42 and boom hoist mechanism will be used together to control the boom descent.

In one embodiment, the cylinder 42 can be extended from a length of about 100 inches when fully retraced to about 312 inches when fully extended. An example boom raising assist structure allows a particular Manitowoc crane to have an increased boom length of nearly 60 feet, to a maximum boom length of 374 feet.

There are several advantages of the preferred embodiment of the invention. First, the boom raising assist structure supplements the crane's tipping resistance about the front fulcrum, allowing the crane to raise longer and/or heavier booms. The raising assist cylinder will supplement the crane stability during boom raising as the cylinders create a moment about the fulcrum to help raise the boom. Preferably the tipping resistance can be increased by about 25%. Second, this is done without requiring the structural capacity of the crane to be increased. In fact, using the preferred boom raising assist structure reduces the loads in the crane boom supporting structure, preferably by about 35%, because the cylinders 42 produce a large assisting moment about the boom hinge pin. Third, use of the invention changes the deflected shape of the boom when raising the boom, causing the boom to "lift" in the middle instead of "sagging". This helps reduce the maximum boom chord stress. Fourth, the present invention can be applied to existing cranes to increase their boom raising ability. The boom raising assist structure can be designed to fit between the boom butt and the first boom insert and used with a crane without having to modify any other parts of the crane.

It should be understood that various changes and modifications to the presently preferred embodiments described herein will be apparent to those skilled in the art. The invention is applicable to other types of cranes besides crawler cranes, and is particularly useful on truck mounted cranes and rough terrain cranes. Instead of the boom hoist drum and rigging being used to change the boom angle, a hydraulic cylinder connected between the rotating bed and the boom could be used for the boom hoist mechanism. Also, instead of a live mast, a fixed mast with an equalizer between the top of the mast and the top of the boom could be used to change the boom angle during operation. Rather than being mounted to a frame that is inserted between boom sections, the boom raising assist structure could be mounted directly to a section of the boom. Also, rather than using multistage hydraulic cylinders, other devices could be used to raise the boom, such as long single stage hydraulic cylinders with a trunnion mount connection to the boom, or some other device that had a fixed length with a moveable member on it that attached to the boom. The boom hoist drum 50 and lower sheave set 37 do not need to be directly connected to the rotating bed. For example the lower sheave set might be connected to the rotating bed by being mounted on a gantry. Such changes and modifications can be made without departing from the spirit and scope of the present invention and without diminishing its intended advantages. It is therefore intended that such changes and modifications be covered by the appended claims.

The invention claimed is:

1. A lift crane comprising:

a) a carbody;

b) ground engaging members elevating the carbody off the ground;

c) a rotating bed rotatably connected to the carbody;

d) a boom pivotally mounted at a first end to the rotating bed with a load hoist line extending adjacent a second end of the boom;

e) a boom hoist mechanism that can be used to change the angle of the boom relative to the rotating bed during crane operation; and f) a boom raising assist structure connected to the boom between the first end of the boom and the center of gravity of the boom comprising:

i) at least one ground engaging member in contact with the ground; and ii) a boom elevating member extending between the assist structure ground engaging member and the boom, the boom elevating member supporting at least a part of the weight of the boom and being positioned so that it help supports the boom when the boom is at a horizontal position relative to the ground; and is configured to help raise the boom while the boom is raised to an angle of at least 5°;

iii) wherein the weight and length of the boom are sufficient to generate a moment that would tip the crane if the crane boom hoist mechanism were to attempt to lift the boom off the ground without using the boom raising assist structure.

2. The lift crane of claim 1 wherein the boom elevating member comprises an extendable cylinder.

3. The lift crane of claim 2 wherein the extendable cylinder is hydraulically operated.

4. The lift crane of claim 3 wherein the hydraulic cylinder comprises at least three stages.

5. The lift crane of claim 1 wherein the boom hoist mechanism comprises a boom hoist drum connected to the rotating bed and boom hoist rigging connected between the boom hoist drum and the second end of the boom.

6. The lift crane of claim 1 wherein the boom elevating member is positionable so that it can help support the boom when the boom is at a horizontal position relative to the ground and can continue to help support the boom when the boom is raised to a first angle where the crane has a boom reserve of at least 1% of the boom top weight.

7. The lift crane of claim 1 wherein the boom elevating member is connected to the boom with a pivotal connection allowing the boom elevating member to pivot about the boom connection as the boom is raised.

8. The lift crane of claim 1 further comprising at least one pendant connected between the carbody and the assist structure ground engaging member.

9. The lift crane of claim 1 wherein the boom raising assist structure comprises two multistage telescoping hydraulic cylinders each having a jack pad attached as the assist structure ground engaging member.

10. The lift crane of claim 1 further comprising at least one pendant connecting between the boom and the boom elevating member when the rotating bed rotates with respect to the carbody and ground engaging members.

11. The lift crane of claim 9 wherein the two cylinders are attached to a frame and the boom is made of a plurality of boom sections, and the frame is connected between sections of the boom.

12. The lift crane of claim 1 wherein the crane is a mobile lift crane and the ground engaging members elevating the carbody are moveable ground engaging members.

13. A method of setting up a lift crane wherein the lift crane comprises, during operation, a carbody; ground engaging members elevating the carbody off the ground; a rotating bed rotatably connected to the carbody; a boom pivotally mounted at a first end to the rotating bed with a load hoist line extending adjacent a second end of the boom; a boom hoist mechanism that can be used to change the angle of the boom relative to the rotating bed during crane operation; and a boom raising assist structure; the method comprising:

a) attaching the first end of the boom to the rotating bed and constructing the boom, with the boom extending out from the rotating bed parallel to the ground and being supported by the ground in a first position, and the weight and length of the boom being sufficient to generate a moment that would tip the crane if the crane boom hoist mechanism were to attempt to lift the boom off the ground without using the boom raising assist structure;

b) positioning the boom raising assist structure between the ground and the boom, with the boom raising assist structure connected to the boom;

c) using the boom raising assist structure and the boom hoist mechanism together to pivot the boom about its connection to the rotating bed, and raising the boom from the first position to a second position defining a first boom angle, the first boom angle being at least as large as the boom angle needed so that the moment generated by the boom will no longer tip the crane even if the boom raising assist structure were no longer in contact with the ground; and d) using the boom hoist mechanism to raise the boom to a second angle steeper than the first angle, where the boom raising assist structure is no longer in contact with the ground.

14. The method of claim 13 wherein the boom is constructed by connecting multiple boom sections together, and the section pivotally connected to the rotating bed comprises a boom butt, and the boom butt is only partially connected to its adjoining section when the boom is supported by the ground.

15. The method of claim 14 wherein the boom hoist mechanism includes a live mast, and the live mast is used to lift the boom butt to a point where the boom raising assist structure can be positioned between the ground and the boom, with the second end of the boom being supported by the ground.

16. The method of claim 13 wherein, in the second position, the crane has a boom reserve of between about 2% and about 5% of the boom top weight.

17. The method of claim 13 wherein the boom raising assist structure comprises at least one multistage hydraulic cylinder and the cylinder is extended to raise the boom from said first position to said second position.

18. The method of claim 13 wherein said first angle is between about 20° and 45°.

19. The method of claim 13 wherein the boom raising assist structure remains attached to the boom when the boom is at said second angle.

20. A mobile lift crane comprising:

a) a carbody;

b) moveable ground engaging members elevating the carbody off the ground;

c) a rotating bed rotatably connected to the carbody;

d) a boom pivotally mounted at a first end to the rotating bed with a load hoist line extending adjacent a second end of the boom;

e) a boom hoist drum connected to the rotating bed and boom hoist rigging connected between the boom hoist drum and the second end of the boom, the boom hoist drum and rigging being useable to change the angle of the boom relative to the rotating bed; and f) a boom raising assist structure connected to the boom between the first end of the boom and the center of gravity of the boom comprising two hydraulic cylinders each having a jack pad on a lower end thereof wherein the weight and length of the boom are sufficient to generate a moment that would tip the crane if the crane boom hoist drum and rigging were to attempt to lift the boom off the ground without using the boom raising assist structure.

21. The mobile lift crane of claim 20 wherein the cylinders are pivotally connected to a frame and the frame is secured to the boom such that the cylinders can pivot with respect to the boom between a first position in which the cylinders are generally perpendicular to the centerline of the boom and a second position, the second position being chosen such that, when the boom is being lowered to the ground and reaches an angle at which the boom raising assist structure can be activated to provide stability, the cylinders will be angled to direct the jack pads towards points on the ground a distance in front of the crane substantially equal to the distance that the hydraulic cylinders are from the front of the crane when the boom is in a horizontal position.

22. The mobile lift crane of claim 20 wherein the hydraulic cylinders comprise multistage hydraulic cylinders.

23. The mobile lift crane of claim 20 wherein the extended length of the cylinders is sufficient to help raise the boom to an angle of between about 35° and about 45°.

24. The mobile lift crane of claim 20 wherein the crane further comprises a live mast, and the boom hoist rigging includes fixed length straps between the live mast and the second end of the boom.

25. The method of claim 13 wherein the boom has a center of gravity and the boom raising assist structure is connected to the boom between the first end of the boom and the center of gravity of the boom.

* * * * *